US007133634B2

(12) United States Patent
Komuro et al.

(10) Patent No.: US 7,133,634 B2
(45) Date of Patent: Nov. 7, 2006

(54) CIRCULATING BODY AND FIXING DEVICE

(75) Inventors: Hitoshi Komuro, Minamiashigara (JP); Hiroshi Tamemasa, Minamiashigara (JP); Yousuke Tsutsumi, Minamiashigara (JP); Kenji Nakatogawa, Minamiashigara (JP); Kei Inamura, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 228 days.

(21) Appl. No.: 10/782,816

(22) Filed: Feb. 23, 2004

(65) Prior Publication Data

US 2005/0013639 A1 Jan. 20, 2005

(30) Foreign Application Priority Data

Jul. 18, 2003 (JP) ..... 2003-277000

(51) Int. Cl.
*G03G 15/20* (2006.01)

(52) U.S. Cl. ..... 399/328; 219/216; 399/329; 399/333

(58) Field of Classification Search ..... 399/328, 399/320, 333; 347/156
See application file for complete search history.

(56) References Cited

U.S. PATENT DOCUMENTS

| | | | | |
|---|---|---|---|---|
| 5,485,259 | A * | 1/1996 | Uehara et al. | 399/325 |
| 6,721,529 | B1 * | 4/2004 | Chen et al. | 399/320 X |
| 2003/0063934 | A1 * | 4/2003 | Takenaka et al. | 399/333 |
| 2004/0057759 | A1 * | 3/2004 | Ogiso et al. | 399/329 |

FOREIGN PATENT DOCUMENTS

| | | | |
|---|---|---|---|
| JP | 08-323937 | A * | 12/1996 |
| JP | 11-24457 | | 1/1999 |
| JP | 2003-140486 | A * | 5/2003 |

* cited by examiner

*Primary Examiner*—Sophia S. Chen
(74) *Attorney, Agent, or Firm*—Morgan, Lewis & Bockius LLP

(57) ABSTRACT

A circulating body driven with its surface being circulated along a fixed route and having a base material provided with a tubular outside peripheral surface and a surface layer covering the outside peripheral surface of the base material, the surface static friction coefficient of the surface layer is designed to be 0.06 or less with common paper at 100° C.

18 Claims, 2 Drawing Sheets

LEGEND

113: heat resistant elastic body layer made of a silicone rubber

114: heat resistant peelable layer made of a fluroresin

CIRCULATING BODY AND FIXING DEVICE

BACKGROUND OF THE INVENTION

1. Field of the Invention

The present invention relates to a circulating body that is used for a fixing device fixing an unfixed image under heating and pressure in an image forming device such as copiers, printers and facsimile machines and is driven in such a manner that its surface is circulated along a fixed route and also to a fixing device using the circulating body.

2. Background Art

It is usually necessary to form a permanent image by fixing an unfixed toner image formed on a recording sheet in copiers and the like making use of an electrophotographic process. As the fixing method, a solvent fixing method, pressure fixing method and heat fixing method are known. Among these fixing methods, the solvent fixing method has the drawback that solvent vapor is emitted during fixing, giving rise to many problems concerning odors and sanitation. The pressure fixing method has the drawback that it is inferior in fixing characteristics to other fixing methods. Accordingly, the solvent fixing method and the pressure fixing method are both limited in the range of practical fields and therefore, the heat fixing method in which a toner is melted under heating to fuse it on a recording sheet (image-receiving material) is widely used.

As a device used in such a heat fixing method, a heat fixing device is known which has a heat roll (also called a fixing roll) provided with a heater lamp inside of a cylindrical core bar and a heat resistant releasable layer formed on the outside peripheral surface of the core bar and a pressure roll disposed in pressure contact with the heat roll and having a structure in which a heat resistant elastic body layer is formed on the outside peripheral surface of a cylindrical core bar. In the heat fixing device having this structure, a pressure of 1 to 15 kg/cm$^2$ (preferably 3 to 10 kg/cm$^2$) is applied to the heat roll and the pressure roll from each other and a recording sheet such as a common paper on which an unfixed toner image is formed is inserted and passed through between both rolls to thereby fix, and fixing using a heat fixing roll system is thus carried out. In the heat fixing device as aforementioned, the surface of the pressure roll is moved circularly on a fixed route and this pressure roll is a sort of the aforementioned circulating body.

The heat fixing device (heat roll type fixing device) adopting this heat fixing roll system has higher heat efficiency than devices using other fixing systems such as a hot air fixing system and an oven fixing system and therefore, the heat fixing device requires low power, is superior in high speed performance and is reduced in danger of a fire caused by paper jamming. This heat fixing device is therefore most widely used.

However, more energy saving and more promotion of fixing speed are both desirably accomplished in recent heat fixing devices. In order to satisfy this, it is necessary to increase the width of a nip zone, namely a nip width, that actually sandwiches a recording sheet when fixing under heating. Under this situation, a belt nip type fixing device has been recently developed to solve these problems.

As the belt nip type fixing device, for instance, a device is known which is provided with a rotating heat fixing roll with a built-in heating source, a resin film tubular body that is in pressure contact with the heat fixing roll and is moved with rotating together with the heat fixing roll and a pressure pad that is disposed inside of the resin film tubular body and presses the resin film tubular body against the heat fixing roll to form a nip section between the resin film tubular body and the heat fixing roll and fixes an unfixed toner image to a recording sheet by passing the recording sheet through the nip section (see, for example, Japanese Patent Application Laid-open No. 11-24457). In such a belt nip type fixing device, the surface of the resin film tubular body is moved circularly on a fixed route and is therefore also a sort of the aforementioned circulating body.

As the circulating bodies such as the resin film tubular body and the pressure roll, those having a layer of a copolymer (hereinafter abbreviated as PFA if necessary) of tetrafluoroethylene and perfluoroalkyl vinyl ether on the surface and those having a rubber type surface are used to obtain releasability from a recording sheet and a toner image.

Also, in the belt nip type fixing device, a lubricating material such as a lubricant or a low-friction film is interposed between the pressure pad and the resin film tubular body to thereby reduce sliding resistance between the resin film tubular body and the fixed pressure pad.

However, the belt nip type fixing device has the problem that when the lubricating material is thermally deteriorated or worn with working time, the sliding resistance between the resin film tubular body and the fixed pressure pad is raised, with the result that the running of the recording sheet becomes unstable, leading to occurrences of paper wrinkles and image defects.

Such a problem is a particular one regarded as important in the belt nip type fixing device. However, this problem is not exclusive in the belt nip type fixing device but possibly arises likewise even in the aforementioned heat roll type fixing device in the case where the resistance of the pressure roll (circulating body) is increased when its surface is circulated.

SUMMARY OF THE INVENTION

The present invention has been made in view of the above circumstances and provides a solution to the above problem and a highly reliable circulating body that can prevent the unstable running of a recording sheet, paper wrinkles and image defects and also a highly reliable fixing device using the circulating body.

According to the present invention, there is provided a circulating body driven with its surface being circulated along a fixed route, the circulating body comprising:

a base material having a tubular outside peripheral surface; and a surface layer covering the outside peripheral surface of the base material and having a surface static friction coefficient of 0.06 or less with common paper at 100° C.

The inventors of the present invention have made earnest studies and as a result, found that the running stability of a recording sheet in the case where the resistance of a circulating body when its surface is circulated is raised along with a change with time is improved when the friction coefficient of the surface layer is dropped to the above value or less and the occurrences of paper wrinkles and image defects are remarkably suppressed. This reason is considered to be that when a recording sheet is passed through the aforementioned nip zone, a rise of the sliding resistance of the circulating body has such an influence as to brake the transfer of the recording sheet in usual whereas, in the present invention, a phenomenon occurs that the above influence is lessened because the surface of the circulating body and the surface of the sheet are slipped on each other.

This phenomenon emerges when the friction coefficient is dropped to the above value or less.

According to the present invention, there is provided a fixing device comprising:

a rotating roll-like fixing member;

a fixing tubular body rotating along with the rotation of the fixing member in contact with the fixing member;

a press member that is disposed inside of the fixing tubular body and presses the fixing tubular body against the fixing member to form a nip zone between the fixing tubular body and the fixing member; and a heating source that heats the nip zone; to fix an unfixed toner image to a recording medium by holding a recording medium carrying an unfixed toner image in the nip zone, wherein;

the fixing tubular body is provided with a seamlessly belt-like base material and a surface layer covering the outside peripheral surface of the base material and having a surface static friction coefficient of 0.06 or less with common paper at 100° C.

According to the fixing device of the present invention, a recording sheet can be slipped through the nip zone by the surface layer having a surface static friction coefficient of 0.06 or less even if the resistance of the fixing tubular body during rotation is increased with the result that the running stability of a recording sheet is high and the occurrence of paper wrinkles and image defects can be remarkably suppressed.

According to the present invention, a circulating body that is highly reliable for a long time and can be significantly limited in the unstable running condition of a paper and the occurrence of paper wrinkles and image defects even if the resistance when the surface is circulated is increased and a highly reliable fixing device can be provided.

BRIEF DESCRIPTION OF THE DRAWINGS

Preferred embodiments of the present invention will be described in detail based on the following figures, wherein.

DESCRIPTION OF THE PREFERRED EMBODIMENTS

The embodiments of the present invention will be described with reference to the drawings.

Figure 1:
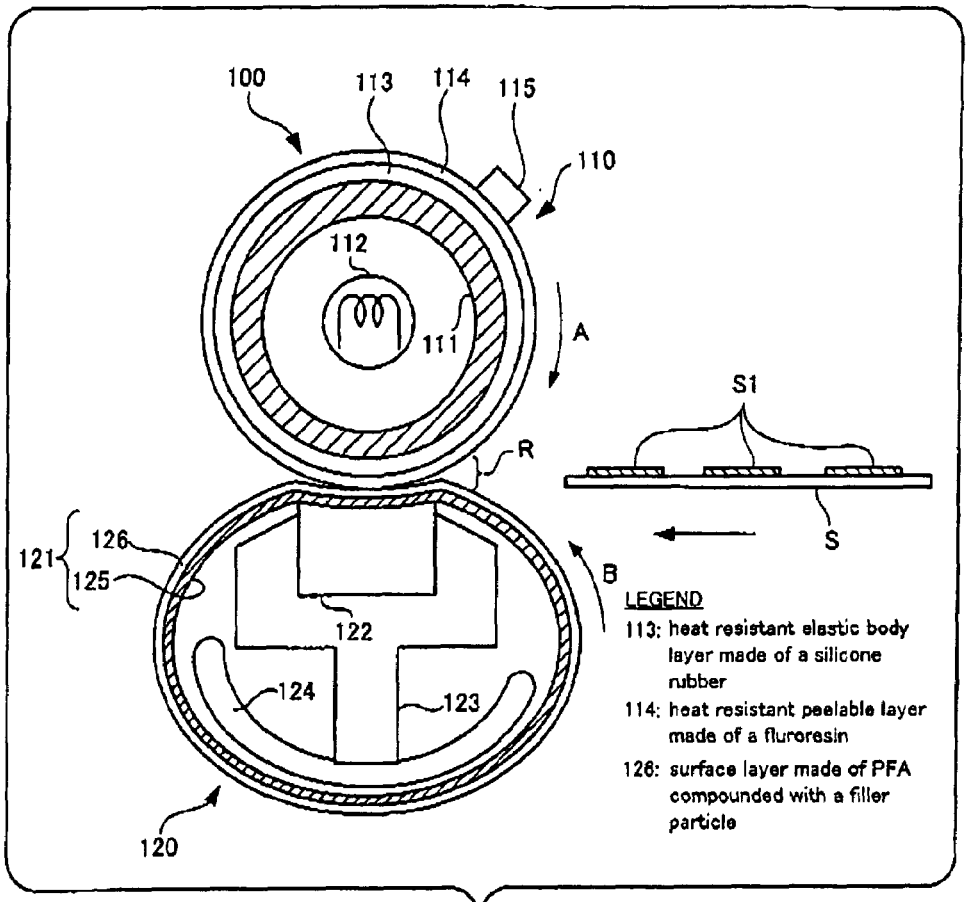
FIG. 1 is a sectional view typically showing a first embodiment of the present invention.

FIG. 1 is a sectional view typically showing a first embodiment of the present invention.

FIG. 1 shows a heat fixing device 100 and a recording sheet S provided with an unfixed toner image formed on its surface.

The heat fixing device 100 shown in FIG. 1 is a device aiming at both the promotions of small size-energy saving and high-speed. The heat fixing device 100 is provided with a heating roll 110 that melts an unfixed toner S1 put on the recording sheet S under heating and a pressure section 120 that presses the molten unfixed toner S1 against to the recording sheet S.

The heating roll 110 is provided with a heat source 112 inside of an aluminum core body 111 having a cylindrical form, a heat resistant elastic body layer 113 made of a silicone rubber is disposed around the core body 111 and a heat resistant peelable layer 114 made of a fluororesin is further disposed around the heat resistant elastic body layer 113. The structure of the heating roll 110 is a usual one which has been known so far and not only the structure shown here but also other known structures may be adopted. The following explanations will be furnished on the premise that the structure shown in FIG. 1 is adopted.

A temperature sensor 115 is also provided that controls the temperature of the surface of the heating roll 110 at a fixed position in contact with the surface of the heating roll 110. The heat source 112 is turned on or off according to the temperature detected by the temperature sensor 115 and the surface temperature of the heating roll 110 is controlled to the temperature necessary to fix the toner S1 to the recording sheet S.

In the meantime, the pressure section 120 is provided with a pressure belt 121, a pressure pad 122 that presses the pressure belt 121 against the heating roll 110 from the inside, a support member 123 that supports this pressure pad 122 and a belt running guide 124 that aids the running of the pressure belt 121.

The fixing device provided with the heating roll 110 and the pressure belt 121 in this manner is called a heat roll-belt type fixing device.

The pressure belt 121 of the pressure section 120 is in pressure contact with the heating roll 110 by the pressure pad 122. Therefore, when the heating roll 110 is rotated in the direction of the arrow A in the figure by a motor (not shown), the pressure belt 121 follows the heating roll 110 and is rotated and moved in the direction of the arrow B. In the pressure section 120, a support roll and a pressure roller for holding and spreading the pressure belt 121 are not present and the pressure belt 121 is guided along a belt running guide 124 and driven by driving force from the heating roll 110. Fixing devices like this are called a free-belt fixing device to discriminate it from a type having a support roll and a pressure roll.

The pressure pad 122 is pressed against the pressure belt 121 through a low-friction material (illustration is omitted) such as a glass fiber sheet including Teflon (trademark) or fluororesin sheet and a nip zone R where the pressure belt 121 has a shape concaved in the pressure section 120 side is formed.

The recording sheet S transferred from the upstream side of the transfer route (not shown) is passed through the nip zone R between the heating roll 110 and the pressure belt 121 and transferred to the downstream side. When the recording sheet S is passed through the nip zone R, the unfixed toner S1 on the recording sheet S is heated and melted by the heat source 112. Also, at this time, the recording sheet S is pressed against the heating roll 110 by the pressure pad 122 with the pressure belt 121 being interposed between the recording sheet S and the pressure pad 122, whereby the toner image is fixed to the recording sheet S. The recording sheet S after fixed is peeled from the heating roll 110 by a peeling click (not-shown) after passed through the nip zone R and then discharged from the heat fixing device 100.

The pressure pad 122 disposed inside of the pressure section 120 is preferably made of two parts that are disposed side by side and differ in hardness. If, for example, the part on the side (upstream side) where the recording sheet is inserted is constituted of a rubber-like elastic member and the part on the side (downstream side) where the recording sheet is discharged is constituted of a hard pressure-imparting member such as metals, the pressure to be applied to the recording sheet in the nip zone is higher in the downstream side than in the upstream side, with the result that the releasability of particularly, a thin recording sheet is improved.

Also, the time (nip time) required for the recording sheet S to pass through the nip zone R is desirably 0.020 seconds or more. When the nip time is shorter than 0.020 seconds, it is difficult to attain both the good fixing characteristics and the prevention of paper wrinkles and curling and it is therefore necessary to raise fixing temperature corresponding to a reduction in the nip time, which brings about waste of energy, a reduction in the durability of parts and a rise in the temperature of the device, which is undesirable. Although no particular limitation is imposed on the upper limit of the nip time, the upper limit of the nip time is preferably 0.5 seconds or less from the viewpoint of the balance between fixing capacity and the sizes of the device and members.

The parts having the characteristics of the embodiment of the present invention are the pressure section 120 and the pressure belt 121 and the details of the pressure belt 121 will be hereinafter explained.

The pressure belt 121 is an endless belt constituted of a seamlessly belt-like base material 125 and a surface layer 126 covering the outside peripheral surface of the base material 125 and the surface layer 126 has a surface static friction coefficient of 0.06 or less with common paper at 100° C.

As the base material 125, any material may be used as far as this pressure belt 121 (endless belt) has a strength enough to rotate following the heating roll 110 and, for example, a polymer film, metal film, ceramics film, glass fiber film or complex film obtained by compounding two or more of these films may be used. Examples of the polymer film include sheet-like or cloth-like products such as polyesters such as a polyethylene terephthalate, polycarbonates, polyimides, fluorine type polymers such as a polyvinyl fluoride and tetrafluoroethylene, polyamides such as nylon, polystyrenes and polyacryls, polyethylenes and polypropylenes, cellulose modified materials such as polycellulose acetates, polysulfones, polyxylylenes and polyacetals. Further, examples of the polymer film may also include polymer complex products obtained by laminating, for example, a fluorine type, silicone type or crosslinking polymer type heat resistant resin layer. The base material is particularly preferably constituted of an endless belt like heat resistant resin (e.g., a polyimide resin) among these materials.

Also, such a polymer film may be combined with a heat resistant layer formed of a metal or ceramics. Also, a heat conductivity improver such as granular, needle or fiber-like carbon black, graphite, alumina, silicon, carbide and boron nitride may be added in the inside of the polymer film. Also, additives such as an electroconductive improver, antistatic agent, release agent and reinforcing agent may be added or applied to the inside or the surface of the polymer film according to the need. Besides the above polymer films, papers such as condenser paper and glassine paper, ceramics type films or glass fiber films formed cloth-wise using glass fiber and metal films such as stainless films and nickel films may be used.

The thickness of the base material 125 is preferably 30 μm to 250 μm and more preferably 50 μm to 150 μm.

In this embodiment, an adhesive called a primer is applied and then a surface layer 126 constituted of a copolymer (PFA) of tetrafluoroethylene and a perfluoroalkyl vinyl ether in which a filler particle is compounded as will be described later for pretreatment forming the surface layer. However, an embodiment in which the surface layer 126 is directly formed on the endless belt-like non-sintered base material or an embodiment in which an intermediate layer such as a heat resistant elastic layer is disposed between the base material 125 and the surface layer 126 as required are preferable embodiments.

As the structural material of the surface layer 126, a PFA which is superior in heat resistance and flexibility particularly necessary for structural parts of the heat fixing device from among fluororesins having low adhesiveness and high releasability is adopted as a major material. The friction coefficient of the surface with paper at high temperatures is dropped to the above value or less by compounding a specific filler material in this PFA as will be explained later. As a consequence, such a high reliability is attained that even if sliding resistance along with the rotation and movement of the pressure belt 121 is increased, the running stability of paper is high and the occurrences of paper wrinkles and image defects can be prevented for a long term while maintaining high releasability from a toner and high durability.

If only a PFA is used as usual as the structural material of the surface layer, the friction coefficient with a paper at high temperatures is high because of the smoothness of the PFA, giving rise to the problem that paper wrinkles are caused in the case where the sliding resistance of a circulating body (pressure belt) is raised when using a device with time. On the contrary, when a specific filler particle is compounded in the PFA as aforementioned in this embodiment, the friction coefficient of the surface with a paper is dropped. Therefore, the running stability of a paper is kept high when sliding resistance is increased and it is also possible to improve abrasion resistance.

The filler particle to be compounded in the surface layer 126 (PFA film) is an inorganic fine particle and preferably contains at least one fine particle selected from the group consisting of metal oxide fine particles, mineral silicate fine particles and metal nitride fine particles. Also, this filler particle more preferably contains at least one fine particle selected from the group consisting of $BaSO_4$ fine particles, tin oxide fine particles, zeolite fine particles, mica fine particles, and boron nitride fine particles and is particularly preferably a $BaSO_4$ fine particle.

As the metal oxide fine particle used for the filler particle, fine particles of silicon oxide, copper oxide, iron oxide and zirconium oxide besides tin oxide fine particles may be adopted. Also, as the metal nitride fine particle used for the filler particle, fine particles of silicon nitride and titanium nitride besides boron nitride fine particles may be adopted.

Various surface characteristics of the surface layer 126 can be controlled by compounding the aforementioned filler particle in the fluororesin (particularly PFA) and by selecting the type of material and the amount of to be compounded. Desirable characteristics will be mentioned hereinbelow.

The center average surface roughness (Ra) of the surface layer 126 is preferably in a range of 3 μm or less. When the surface roughness is larger than 3 μm, the surface gloss of the surface layer is dropped, giving rise to the problem that the gloss of a fixed image when forming an image on both surfaces is dropped. Also, the problem probably arises that when some roughness appears, the roughness affects an image.

Also, the surface layer 126 has a surface gloss ranging preferably from 15 to 60 and more preferably 20 to 50 as a value measured by a 75° micro-gloss meter. When the surface gloss is smaller than 15, the gloss of the fixed image tends to be dropped when forming an image on both surfaces. Also, in the case of glossy coated paper, the gloss of an image is lower than that of a paper and there is therefore the case where the quality of the output product is deteriorated. On the other hand, when the surface gloss exceeds 60, there is the case where the adhesion of the surface layer to a paper is too high, causing paper wrinkles.

Moreover, the surface layer 126 has a filtered wave center line waviness of preferably 0.9 μm or less and more preferably 0.7 μm or less in the condition of 0.25 mm cutoff. When a wave pattern (slow irregularities, height: several μm, pitch: 0.05 to several mm) appears on the surface of the surface layer 126, this leads to transmission unevenness of OHPs. It is possible to prevent transmission unevenness of OHPs by making the filtered wave center line waviness fall in the above range.

Although the proportion of the filler particle to be compounded in the surface layer (PFA film) may be set to a desired proportion, the proportion of the filler particle to be compounded is preferably in a range from 1 mass part to 30 mass parts and more preferably in a range from 3 mass parts to 15 mass parts based on 100 mass parts of the fluororesin.

When the proportion of the filler particle to be compounded is less than 1 mass part, scratches and the like are easily generated on the surface of a pressure belt and the friction coefficient of the surface with a paper at high temperatures is raised because abrasion resistance to contact materials such as a peeling click is inferior though the surface layer has high releasability from a toner and a paper due to high releasability that the PFA has. For this, the aforementioned advantages in this embodiment, namely, the advantages that even if sliding resistance of the pressure belt is increased, the running stability of a paper is high and the occurrences of paper wrinkles and image defects can be prevented for a long term while maintaining high releasability from a toner and high durability are damaged.

Also, if the proportion of the filler particle to be compounded exceeds 30 mass parts, it is difficult to obtain a uniform dispersion state of the filler particle, causing not only uneven film thickness but also a reduction in the high releasability that the PFA has and toner offset tends to be caused. Also there is the case where the surface characteristics of the surface layer such as surface roughness and gloss are deviated from the above range and the gloss of an image is dropped and a rough image appears.

The average particle diameter of the filler particle is preferably 0.1 μm or more and 15 μm or less, more preferably 1 μm or more and 10 μm or less and still more preferably 2 μm or more and 8 μm or less. The filler particle has a particle having a size of 15 μm or more in an amount of preferably 25 mass % or less, more preferably 5 mass % or less and still more preferably 3 mass % or less from the viewpoint of avoiding the generation of fine acute projections on the surface layer and obtaining a surface having fine cavities.

When the average particle diameter of the filler particle is less than 0.1 μm, the gross surface area of powders becomes excessively large and there is the case where it is difficult to disperse the filler particle uniformly when it is added to the PFA. Also, when the average particle diameter of the filler particle is larger than 10 μm, there is the case where the problem that the surface of the surface layer is too roughened arises. Also, when the amount of particles having a particle diameter larger than 15 μm or more exceeds 5 mass %, the filler particles having a large particle diameter tend to form acute projections like prickles. These acute projections pierces an image when an image is formed on both surfaces and there is the case where white void-like image defects are caused. The filler particle may contain particles 15 μm or less in size in an amount up to 25 mass % or less in the case of forming the surface layer 126 through a step of cutting the acute projections.

As the filler particle, a conductive particle may be used. For example, there is the case where it is demanded of the pressure belt 121 to have conductivity to prevent image deterioration resulting from disturbance of an unfixed toner caused by the electrification of the pressure belt 121. In this case, a conductive particle is compounded as the filler particle to form the surface layer 126 to thereby be able to impart conductivity to the pressure belt 121. As the conductive particle, carbon black, ITO (tin doped indium oxide) or the like may be used. When a conductive particle is used as the filler particle, the conductive particle is preferably compounded in a proportion of 1 mass part or more and 10 mass parts or less based on 100 mass parts of the PFA in consideration of such an object as to impart conductivity, the viewpoint of maintaining the releasability of the PFA and such an object as to obtain the good dispersibility of the conductive particle.

The surface characteristics of the surface layer 126 can be improved by compounding the filler particle as aforementioned. Further, if the surface layer 126 is made using a composition of plural types of PFA particles differing in particle diameter and by properly selecting particle diameter, compounding ratio and melt viscosity, the surface characteristics can be more improved.

The thickness of the surface layer 126 is preferably 5 μm to 100 μm and more preferably 15 μm to 60 μm. In order to obtain the surface layer 126 having a such preferable layer thickness and high durability, it is preferable to use a composition of two types of PFA particles differing in particle diameter. Only a PFA particle that has a low melt viscosity, is easily meltable and has a small particle diameter may be used taking it only into consideration to form a non-wavy and smooth surface layer 126. In the case of forming the surface layer 126 having a thickness of 20 μm or more in one filming step using only a PFA particle having a small particle diameter, there is the problem that cracks occur on the surface. On the other hand, the thickness of the surface layer 126 is excessively small, the surface layer is worn by long term use, impairing the durability. On the contrary, if two types of PFA particles are used, the film thickness of the surface layer 126 that can be formed without any crack in one filming step can be extended to the order of about 60 μm and a highly durable surface layer can be materialized at a low cost.

Among these two types of PFA particles, a PFA particle having a small particle diameter (hereinafter referred to as a PFA fine particle) preferably has an average particle diameter of 1 μm or less and a PFA particle having a large particle diameter (hereinafter referred to as a PFA powder) preferably has an average particle diameter of 3 μm or more and 30 μm or less. The average particle diameter of the PFA powder is more preferably 3 μm or more and 15 μm or less and still more preferably 6 μm or more and 10 μm or less. Also, as to the ratio of two types of PFA particles in the composition used for the production of the surface layer 126, a PFA powder having an average particle diameter of 3 μm or more and 30 μm or less is contained in an amount of preferably 5 mass parts or more and 70 mass parts or less, more preferably 5 mass parts or more and 30 mass parts or less and still more preferably 10 mass parts or more and 20 mass parts or less per 100 mass parts of a PFA fine particle constituted of a small diameter particle having an average particle diameter of 1 μm or less. From the viewpoint of more improving the waviness of the surface layer, the formulation of the above composition is as follows: a PFA powder having an average particle diameter of 3 μm or more and 15 μm or less is contained in an amount of preferably 5 mass parts or more and 30 mass parts or less and more preferably 10 mass parts or more and 20 mass parts or less per 100 mass parts of a PFA fine particle.

Here, when the average particle diameter of the PFA powder is smaller than 3 μm and the amount of the PFA powder is less than 5 mass parts per 100 mass parts of the PFA fine particle, cracks tend to be caused on the surface layer 126. On the other hand, when the average particle diameter of the PFA powder is larger than 15 μm and the amount of the PFA powder is larger than 30 mass parts per 100 mass parts of the PFA fine particle, the PFA powder is insufficiently melted during sintering and there is the case where waviness (obtuse angle convex) due to a PFA particle that has not been melted occurs on the surface of the surface layer 126.

These two types of PFA particles differing in particle diameter preferably have the characteristics that the melt viscosity of the PFA fine particle is $3.5\times10^4$ Pa·s or less at 380° C. and the melt viscosity of the PFA powder is $1.5\times10^4$ Pa·s or less at 380° C. Both the PFA fine particle and the PFA powder have a melt viscosity of preferably $1.5\times10^4$ Pa·s or less, more preferably $1.0\times10^4$ Pa·s or less and most preferably $0.5\times10^4$ Pa·s or less at 380° C. from the viewpoint of more improving the waviness of the surface layer. If the melt viscosity of PFA at 380° C. exceeds $1.5\times10^4$ Pa·s, the spread of the molten PFA is low and there is the case where waviness occurs on the surface of the surface layer 126.

It is simple to use a method in which a PFA coating solution prepared by dispersing a PFA particle in a liquid medium is applied to the base material 125 and sintered to manufacture the surface layer 126 in this embodiment. At this time, as the liquid medium, organic solvents such as water and alcohols or mixtures of water and organic solvents may be used. Also, it is preferable to use a surfactant to disperse the PFA particle in the liquid medium. As the surfactant, anionic surfactants and nonionic surfactants are preferable and nonionic surfactants are particularly preferable. These surfactants may be used either singly or in combinations of two or more. The surfactant is used in a ratio enough to disperse the PFA particle uniformly in the liquid medium though no particular limitation is imposed on the amount to be used. It is preferable to use a thickener to make it easy to control film thickness and to apply the PFA coating solution. Although no particular limitation is imposed on the amount of the thickener to be used, the amount is preferably adjusted corresponding to the coating method to make it easy to apply. In the case of compounding the aforementioned two types of PFA particles, procedures are preferable in which a PFA powder is mixed in a dispersion solution prepared by dispersing a PFA fine particle in a liquid medium mixed with a surfactant, although no particular limitation is imposed on the procedures for preparing the PFA coating solution. There is no particular limitation is imposed on a method of applying a PFA coating solution and a known method such as a dipping method, blade coating method and spray method may be used.

As explained above, the surface characteristics (friction coefficient, waviness, gloss and the presence or absence of fine acute projections and fine cavities) of the surface layer 126 can be improved by controlling the materials and proportions of the fluororesin and filler particle constituting the surface layer 126, whereby it is possible to suppress the occurrence of paper wrinkles for a long period of time and to obtain a high quality image (image improved in gloss unevenness when forming an image on both surfaces, image transmission unevenness of OHP papers, white voids of an image and paper end abrasion traces) while maintaining high releasability from a toner and high durability.

As aforementioned, an embodiment in which the circulating body of the present invention is applied to the pressure belt 121 is explained. However, the circulating body of the present invention may also be applied to the form of a roll-like member.

A second embodiment provided with a roll-like member to which the circulating body of the present invention is applied will be hereinafter described.

Figure 2:
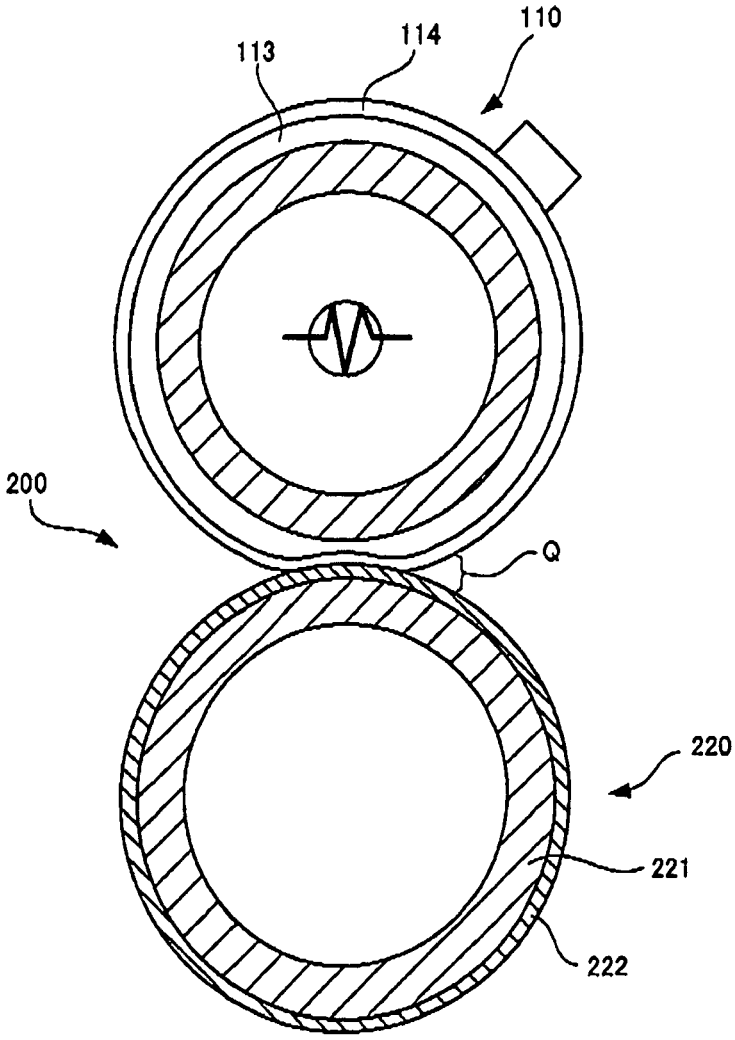
FIG. 2 is a sectional view typically showing a second embodiment of the present invention.

FIG. 2 is a sectional view typically showing the second embodiment of the present invention.

In this FIG. 2, a heat fixing device 200 is shown. This heat fixing device 200 is provided with the same heating roll 110 that is shown in FIG. 1 and a pressure roll 220 in place of the pressure section 120 shown in FIG. 1.

The pressure roll 220 shown here is constituted of a roll-like base material 221 and a surface layer 222 covering the outside periphery of the base material 221. The pressure section 220 is pressed by the heating roll 110, whereby a nip zone Q concaved toward the heating roll 110 side is formed between the pressure section 220 and the heating roll 110.

The surface layer 222 of the pressure roll 220 is manufactured using the same material as the surface layer 126 of the pressure belt 121 shown in FIG. 1 such that the same surface characteristics are obtained. For this, similarly to the pressure belt 121, this pressure roll 220 suppresses the occurrence of paper wrinkles for a long period of time and serves to obtain a high quality image while maintaining high releasability from a toner and high durability.

As another embodiment of a heat fixing device to which the circulating body of the present invention is applied, there is an embodiment in which the pressure belt 121 shown in FIG. 1 is driven by a motor and the heating roll 110 side is driven by the pressure belt 121. In the heat fixing device having this structure, the circulating body of the present invention is applied to the heating roll side driven by the pressure belt 121.

In each of the aforementioned embodiments, one heat source is disposed in the heating roll. However, the fixing device of the present invention may be provided with plural heat sources and also a heat source may be disposed outside the circulating body in the present invention.

EXAMPLE

As examples of the present invention, seven examples will be described in which the material and surface characteristics of the surface layer of the pressure belt in a heat fixing device having the same fundamental structure as the heat fixing device 100 shown in FIG. 1 are changed within the values defined in the present invention. As comparative examples to be compared with the examples, three comparative examples will be explained in which the surface characteristics of the surface layer of the pressure belt in a heat fixing device having the same fundamental structure as the heat fixing device 100 shown in FIG. 1 are deviated from the values defined in the present invention. Also, the results of evaluation in each of the examples and comparative examples will also be explained.

Tables 1 and 2 shown below are tables which collectively show the materials, characteristics and results of evaluation in these examples and comparative examples. Explanations will be furnished with reference to these Tables.

TABLE 1

| | | | Example 1 | Example 2 | Example 3 | Example 4 | Example 5 |
|---|---|---|---|---|---|---|---|
| Structure of a surface layer composition | PFA (100 mass parts) | PFA powder (average particle diameter/mass parts) | (Low melt viscosity) (8 μm/15) | (Low melt viscosity) (8 μm/15) | (Low melt viscosity) (8 μm/15) | (Low melt viscosity) (8 μm/15) | (Low melt viscosity) (8 μm/15) |
| | | Small particle diameter PFA (average particle diameter/mass parts) | (Low melt viscosity) (0.2 μm/85) | (Low melt viscosity) (0.2 μm/85) | (Low melt viscosity) (0.2 μm/85) | (Low melt viscosity) (0.2 μm/85) | (Low melt viscosity) (0.2 μm/85) |
| | Filler (mass parts) | $BaSO_4$ (average particle diameter/mass parts) | (BMH-60) (5 μm/10) | | (BMH-60) (5 μm/5) | | |
| | | Zeolite (average particle diameter/mass parts) | | (Toyobuilder) (2 μm/5) | | | |
| | | Mica (average particle diameter/mass parts) | | | (Iriodin III) (4 μm/3) | | |
| | | BN (average particle diameter/mass parts) | | | | (SP-2) (4 μm/5) | |
| | | $SnO_2$ (Sb doped $SnO_2$) (average particle diameter/mass parts) | | | | | (SN-100D) (0.7/10) |

| | | | Example 6 | Example 7 | Comparative Example 1 | Comparative Example 2 | Comparative Example 3 |
|---|---|---|---|---|---|---|---|
| Structure of a surface layer composition | PFA (100 mass parts) | PFA powder (average particle diameter/mass parts) | (Low melt viscosity) (18 μm/40) | (Low melt viscosity) (18 μm/40) | (Low melt viscosity) (8 μm/15) | (Low melt viscosity) (18 μm/40) | (Low melt viscosity) (18 μm/40) |
| | | Small particle diameter PFA (average particle diameter/mass parts) | (High melt viscosity) (0.2 μm/60) | (High melt viscosity) (0.2 μm/60) | (Low melt viscosity) (0.2 μm/85) | (High melt viscosity) (0.2 μm/60) | (High melt viscosity) (0.2 μm/60) |
| | Filler (mass parts) | $BaSO_4$ (average particle diameter/mass parts) | (BA) (8 μm/10) | (BA) (8 μm/15) | | | (BA) (8 μm/33) |
| | | Zeolite (average particle diameter/mass parts) | | | | | |
| | | Mica (average particle diameter/mass parts) | | | | | |
| | | BN (average particle diameter/mass parts) | | | | | |
| | | $SnO_2$ (Sb doped $SnO_2$) (average particle diameter/mass parts) | | | | | |

TABLE 2

| | | Example 1 | Example 2 | Example 3 | Example 4 | Example 5 | Example 6 | Example 7 | Comparative Example 1 | Comparative Example 2 | Comparative Example 3 |
|---|---|---|---|---|---|---|---|---|---|---|---|
| Material characteristics | Friction coefficient at high temperatures (with J paper) | 0.054 | 0.056 | 0.051 | 0.050 | 0.057 | 0.057 | 0.055 | 0.073 | 0.066 | 0.065 |
| | Contact angle with water (°) | 115 | 114 | 115 | 115 | 114 | 115 | 112 | 113 | 113 | 110 |
| | Surface roughness (Ra) (μm) | 1.1 | 0.9 | 1.0 | 1.3 | 0.8 | 1.6 | 2.7 | 0.15 | 0.2 | 3.5 |
| | Surface gloss | 28 | 36 | 39 | 29 | 35 | 35 | 22 | 77 | 75 | 7 |
| | Evaluation of waviness | 0.53 | 0.58 | 0.45 | 0.68 | 0.65 | 0.75 | 0.86 | 0.25 | 0.77 | 1.5 |
| Evaluation | Durability to paper wrinkles | ○ | ○ | ○ | ○ | ○ | ○ | ○ | x | x | ○ |
| | Image glossiness when an image is formed on both surfaces | ○ | ○ | ○ | ○ | ○ | ○ | ○ | ○ | ○ | x |
| | OHP image transmission unevenness | ○ | ○ | ○ | ○ | ○ | Δ | Δ | ○ | Δ | x |
| | White void of an image | ○ | ○ | ○ | ○ | ○ | Δ | Δ | ○ | ○ | x |
| | Paper abrasive trace | ○ | ○ | ○ | ○ | ○ | ○ | ○ | x | x | ○ |

Example 1

In the first example, a fluororesin solution (manufactured by Mitsui•Du Pont Flurochemical) prepared by mixing a PFA powder having an average particle diameter of 8 μm and a low melt viscosity ($0.3\times10^4$ to $0.5\times10^4$ Pa·s; 380° C.) with a PFA dispersion, prepared by dispersing a PFA fine particle having an average particle diameter of. 0.2 μm and a low melt viscosity ($0.3\times10^4$ to $0.5\times10^4$ Pa·s; 380° C.) in an aqueous solvent, in the following ratio: PFA powder/PFA fine particle=15/85, is used as the material of the surface layer.

Also, as the filler particle, barium sulfate (BMH-60, manufactured by Sakai Chemical Industry Co., Ltd.: average particle diameter: 5 μm, and content of a large particle 15 μm or more in size is 2 mass % or less) is used and compounded in an amount of 10 mass parts based on 100 mass parts of PFA.

Here, the ratio of "PFA powder/PFA fine particle=15/85" means that the PFA powder is about 18 mass parts per 100 mass parts of the PFA fine particle. This ratio exists not only within the aforementioned preferable range, namely, "the PFA powder is 5 mass parts or more and 70 mass parts or less per 100 mass parts of the PFA fine particle" but also within the aforementioned more preferable range, namely, "the PFA powder is 5 mass parts or more and 30 mass parts or less per 100 mass parts of the PFA fine particle".

Also, the characteristics of the filler particle that "the amount of a large particle 15 μm or more in size is 2 mass % or less" ensures that the ratio of the filler particle exists not only within the aforementioned preferable range, namely, "particles having a particle diameter of 15 μm or more is 25 mass % or less" but also within the aforementioned more preferable range, namely, "particles having a particle diameter of 15 μm or more is 5 mass % or less" and within the aforementioned still more preferable range, namely, "particles having a particle diameter of 15 μm or more is 3 mass % or less".

The gloss of the surface layer in the first example is 28 as the value measured by a 75° micro-gloss meter (BYK Gardner). Also, the surface roughness Ra of the surface layer is 1.1 μm and the filtered wave center waviness of the surface layer is 0.53 μm in the condition of a cutoff of 0.25 mm. Further, the static friction coefficient of the surface layer with common paper at 100° C. is measured and as a result, found to be 0.054. In the measurement, a Friction Player manufactured by RHESCA COMPANY, LIMITED is used, J paper manufactured by Fuji Xerox Co., Ltd. is used as the common paper and the rotating speed of the table is 0.5 mm/sec (reciprocating motion (angle of rotation: 10°)).

Example 2

In the second example, the same material in the first example is used except that zeolite (Toyobuilder (manufactured by Tosoh Corporation), average particle diameter: 2 μm) is used as the filler particle in place of barium sulfate in the first example in an amount of 5 mass parts in 100 mass parts of PFA.

Here, the proportion of "5 mass parts" of the filler particle is close to the lower limit of the aforementioned preferable proportion, namely, "the amount of the inorganic fine particle is 3 mass parts or more and 15 mass parts or less based on 100 mass parts of the fluororesin".

The gloss of the surface layer in the second example is 36 as the value measured by a 75° micro-gloss meter (BYK Gardner). Also, the surface roughness Ra of the surface layer is 0.9 μm and the filtered wave center waviness of the surface layer is 0.58 μm in the condition of a cutoff of 0.25 mm. Further, the static friction coefficient of the surface layer with a common paper at 100° C. is measured and as a result, found to be 0.056.

Example 3

In the third example, the same material in the first example is used except that as the filler particle, a mixture of barium sulfate (BMH-60, manufactured by Sakai Chemical Industry Co., Ltd., average particle diameter: 5 μm, large particles having a particle diameter of 15 μm or more is 2 mass % or less) and mica (Iriodin$^{(R)}$ 111 manufactured by Japan Merk Co., Ltd.) is used, and barium sulfate and mica are compounded in an amount of 5 mass parts and in an amount of 3 mass parts respectively based on 100 mass parts of PFA. Namely, in this example, the mixture of plural types of filler materials is used.

The gloss of the surface layer in the third example is 39 as the value measured by a 75° micro-gloss meter (BYK Gardner). Also, the surface roughness Ra of the surface layer is 1.0 μm and the filtered wave center waviness of the surface layer is 0.45 μm in the condition of a cutoff of 0.25 mm. Further, the static friction coefficient of the surface layer with a common paper at 100° C. is measured and as a result, found to be 0.051.

Example 4

In the fourth example, the same material in the first example is used except that boron nitride (SP-2, manufactured by Denki Kagaku Kogyo Kaisha) is used as the filler particle in place of barium sulfate used in the first example in an amount of 5 mass parts in 100 mass parts of PFA.

Here, the proportion of "5 mass parts" of the filler particle in this example is close to the lower limit of the aforementioned preferable proportion, namely, "the amount of the inorganic fine particle is 3 mass parts or more and 15 mass parts or less based on 100 mass parts of the fluororesin".

The gloss of the surface layer in the fourth example is 29 as the value measured by a 75° micro-gloss meter (BYK Gardner). Also, the surface roughness Ra of the surface layer is 1.3 μm and the filtered wave center waviness of the surface layer is 0.68 μm in the condition of a cutoff of 0.25 mm. Further, the static friction coefficient of the surface layer with a common paper at 100° C. is measured and as a result, found to be 0.050.

The filtered wave center waviness "0.68 μm" in this example is within the aforementioned preferable range "0.9 μm or less in the condition of a cutoff of 0.25 mm" and is also the very upper limit within the aforementioned more preferable range "0.7 μm or less".

Example 5

In the fifth example, the same material in the first example is used except that a water dispersion (SN-100D, manufactured by Ishihara Sangyo Kaisha Ltd., average particle diameter: 0.7 μm) of tin oxide (Sb doped $SnO_2$) is used as the filler particle in place of barium sulfate used in the first example in an amount of 10 mass parts based on 100 mass parts of PFA. Here, the average particle diameter "0.7 μm" of the filler particle in this example is close to the lower limit of the aforementioned preferable range, namely, "0.1 μm or more and 15 μm or less".

The gloss of the surface layer in the fifth example is 35 as the value measured by a 75° micro-gloss meter (BYK Gardner). Also, the surface roughness Ra of the surface layer is 0.8 μm and the filtered wave center waviness of the surface layer is 0.65 μm in the condition of a cutoff of 0.25 mm. Further, the static friction coefficient of the surface layer with a common paper at 100° C. is measured and as a result, found to be 0.057.

This static friction coefficient "0.057" is a coefficient close to the upper limit of the above defined range reading as follows "the surface static friction coefficient with common paper at 100° C. is 0.06 or less".

Example 6

In the sixth example, a fluororesin solution (710CL, manufactured by Mitsui•Du Pont Flurochemical) prepared by mixing a PFA powder having an average particle diameter of 18 μm and a low melt viscosity ($0.3\times10^4$ to $0.5\times10^4$ Pa·s; 380° C.) with a PFA dispersion, prepared by dispersing a PFA fine particle having an average particle diameter of 0.2 μm and a high melt viscosity ($2.7\times10^4$ to $2.9\times10^4$ Pa·s; 380° C.) in an aqueous solvent, in the following ratio: PFA powder/PFA fine particle=40/60, is used as the material of the surface layer.

Also, as the filler particle, barium sulfate (BA, manufactured by Sakai Chemical Industry Co., Ltd.: average particle diameter: 8 μm, and content of a large particle 15 μm or more in size is 17 mass %) is used and compounded in an amount of 10 mass parts based on 100 mass parts of PFA.

Here, the average particle diameter "18 μm" of the PFA powder exists within the aforementioned preferable range reading as follows "3 μm or more and 30 μm or less", but exceeds the upper limit of the aforementioned more preferable range reading as follows "3 μm or more and 15 μm or less".

The melt viscosity of the PFA fine particle, that is, "$2.7\times10^4$ to $2.9\times10^4$ Pa·s; 380° C." satisfies the aforementioned definition reading as follows "$3.5\times10^4$ Pa·s or less at 380° C.", but is out of the more preferable range defined above, which reads as follows "the melt viscosity at 380° C. is $1.5\times10^4$ Pa·s or less".

Moreover, the ratio "PFA powder/PFA fine particle=40/60" means that that the proportion of the PFA powder is about 67 mass parts per 100 mass parts of the PFA fine particle and is close to the upper limit of the aforementioned preferable range reading as follows "the amount of the PFA powder is 5 mass parts or more and 70 mass parts or less per 100 mass parts of the PFA fine particle".

Also, the characteristics of the filler particle that "the amount of a large particle 15 μm or more in size is 17 mass %" ensures that the ratio of the filler particle exists within the aforementioned preferable range reading as follows "particles having a particle diameter of 15 μm or more is 25 mass % or less" but exceeds the aforementioned more preferable range reading as follows "particles having a particle diameter of 15 μm or more is 5 mass % or less".

The gloss of the surface layer in the sixth example is 35 as the value measured by a 75° micro-gloss meter (BYK Gardner). Also, the surface roughness Ra of the surface layer is 1.6 μm and the filtered wave center waviness of the surface layer is 0.75 μm in the condition of a cutoff of 0.25 mm. Further, the static friction coefficient of the surface layer with a common paper at 100° C. is measured and as a result, found to be 0.057.

In this sixth example, a filler particle different from the filler particle used in the fifth example is used. Like the fifth example, this sixth example has a static friction coefficient of "0.057" which is close to the defined value, which reads as follows "the surface static friction coefficient with common paper at 100° C. is 0.06 or less" in the present invention. Also, the filtered wave center waviness "0.75 μm" in this sixth example is within the aforementioned preferable range reading as follows "0.9 μm or less in the condition of a cutoff of 0.25 mm" but somewhat exceeds the upper limit of the aforementioned more preferable range reading as follows "0.7 μm or less".

Example 7

In the seventh example, the same material that is used in Example 6 is used except that the proportion of the filler particle is changed to 15 mass parts based on 100 mass parts of PFA.

Here, the proportion of the filler particle, namely, "15 mass parts based on 100 mass parts of PFA" is equal to the upper limit of the aforementioned preferable proportion reading as follows "the amount of the inorganic fine particle is 3 mass parts or more and 15 mass parts or less based on 100 mass parts of the fluororesin".

The gloss of the surface layer in the seventh example is 22 as the value measured by a 75° micro-gloss meter (BYK Gardner). Also, the surface roughness Ra of the surface layer is 2.7 μm and the filtered wave center waviness of the surface layer is 0.86 μm in the condition of a cutoff of 0.25 mm. Further, the static friction coefficient of the surface layer with common paper at 100° C. is measured and as a result, found to be 0.055. The surface roughness "2.7 μm as Ra" is close to the limit of the aforementioned preferable range reading as follows "3 μm or less as Ra".

Also, the filtered wave center waviness "0.86 μm" in this example is the very upper limit of the aforementioned preferable range reading as follows "0.9 μm or less in the condition of a cutoff of 0.25 mm".

Comparative Example 1

In the first comparative example, only PFA is used as the material of the surface layer and as the PFA, the same PFA that is used in Example 1 is used.

The gloss of the surface layer in the first comparative example is 77 as the value measured by a 75° micro-gloss meter (BYK Gardner). Also, the surface roughness Ra of the surface layer is 0.15 μm and the filtered wave center waviness of the surface layer is 0.25 μm in the condition of a cutoff of 0.25 mm. Further, the static friction coefficient of the surface layer with common paper at 100° C. is measured and as a result, found to be 0.073.

The value "77" of the surface gloss measured here exceeds the upper limit of the aforementioned preferable range reading as follows "15 or more and 60 or less" and the static friction coefficient "0.073" exceeds the limit of the defined value reading as follows "the static friction coefficient with common paper at 100° C. is 0.06 or less" in the present invention.

Comparative Example 2

In the second comparative example, only PFA is used as the material of the surface layer in the same way as in the first comparative example and as the PFA, the same PFA that is used in the sixth and seventh examples is used.

The gloss of the surface layer in the second comparative example is 75 as the value measured by a 75° micro-gloss meter (BYK Gardner). Also, the surface roughness Ra of the surface layer is 0.2 μm and the filtered wave center waviness of the surface layer is 0.77 μm in the condition of a cutoff of 0.25 mm. Further, the static friction coefficient of the surface layer with a common paper at 100° C. is measured and as a result, found to be 0.066.

The value "75" of the surface gloss measured here exceeds the upper limit of the aforementioned preferable range reading as follows "15 or more and 60 or less" and the static friction coefficient "0.066" somewhat exceeds the limit of the defined value reading as follows "the static friction coefficient with common paper at 100° C. is 0.06 or less" in the present invention. Also, the filtered wave center waviness "0.77 μm" is within the aforementioned preferable range reading as follows "0.9 μm or less in the condition of a cutoff of 0.25 mm" but exceeds the aforementioned more preferable range reading as follows "0.7 μm or less" to some extent.

Comparative Example 3

In the third comparative example, the same material that is used in the sixth or seventh example is used except that the proportion of the filler particle is changed to 33 mass parts based on 100 mass parts of PFA.

Here, the proportion of the filler particle which reads as follows "33 mass parts based on 100 mass parts of PFA" somewhat exceeds the upper limit of the aforementioned range reading as follows "the content of the inorganic fine particle is 1 mass part or more and 30 mass parts or less based on 100 mass parts of the fluororesin".

The gloss of the surface layer in the third comparative example is 7 as the value measured by a 75° micro-gloss meter (BYK Gardner). Also, the surface roughness Ra of the surface layer is 3.5 μm and the filtered wave center waviness of the surface layer is 1.5 μm in the condition of a cutoff of 0.25 mm. Further, the static friction coefficient of the surface layer with common paper at 100° C. is measured and as a result, found to be 0.065.

The value "7" of the surface gloss measured here is less than the lower limit of the aforementioned preferable range reading as follows "15 or more and 60 or less", the filtered wave center waviness "1.5 μm" exceeds the upper limit of the aforementioned preferable range reading as follows "0.9 μm or less in the condition of a cutoff of 0.25 mm" and the surface roughness "3.5 μm as Ra" exceeds the limit of the aforementioned preferable range reading as follows "3 μm or less as Ra".

(Result of Evaluation)

The results of evaluation as to each of the examples and comparative examples as described above will be explained hereinbelow.

Each of the aforementioned examples and comparative examples is mounted on DocuCenter Color 400 color composite machine to run 50000 sheets of normal P paper manufactured by Fuji Xerox Co., Ltd. Then, 100 sheets of P paper are run with making a halftone image having an image density of 50%. At this time, evaluations are made as to the occurrence of paper wrinkles, image glossiness and image white void when an image is formed on both surfaces and the generation of abrasive traces at the end part of a paper. Also, image transmission unevenness when forming an image by using OHPs (OHP V516, manufactured by Fuji Xerox Co., Ltd.) is also evaluated.

In all the first to fifth examples, paper wrinkles, image white voids, abrasive traces and transmission unevenness are not caused and image glossiness is also good.

Also, in the sixth and seventh examples, no paper wrinkle occurred and the image transmission unevenness in OHP printing is practically no-problem level though the transmission unevenness is observed a little. Also, the image void when forming an image on both surfaces is practically no-problem level though it is partially observed, abrasive traces at the end of a common paper are not caused and image glossiness when forming an image on both surfaces is good.

Accordingly, it is confirmed that each of the first to seventh examples is free from any practical problem and has good characteristics.

On the other hand, in the first comparative example, the generation rate of paper wrinkles is 50%, abrasive traces at the end of a paper occurred. When running a larger size paper to form an image, abrasive traces emerged as image defects. The image transmission unevenness in OHP printing and the image void when forming an image on both surfaces are not caused and the image glossiness when forming an image on both surfaces is good.

Also, in the second comparative example, the generation rate of paper wrinkles is 30%, abrasive traces at the end of a paper occurred. When running a larger size paper to form an image, abrasive traces emerged as image defects. The image transmission unevenness in OHP printing is observed a little but this is practically no-problem level, there is no image void when forming an image on both surfaces, and the image glossiness when forming an image on both surfaces is good.

Further, in the third comparative example, image transmission unevenness in OHP printing is significantly observed though paper wrinkles and abrasive traces at the end of a paper are unobserved. Also, image glossiness when forming an image on both surfaces is insufficient and there is a significant difference in gloss between the front side and backside images. Further, image voids when forming an image on both surfaces are observed in the condition of an image density of about 50%.

These image defects are all image defects on a level which could not stand to practical use.

The above results of evaluation will be analyzed hereinbelow.

First, when comparing the results of evaluation in each example with the results of evaluation in each comparative example, almost the same good results of evaluation are obtained though the static friction coefficients with common paper at 100° C. extended over a range from 0.050 to 0.057 in seven examples, whereas the static friction coefficient extended over a range from 0.065 to 0.073 in three comparative examples and it is found that all of these comparative examples exhibit serious disorders. This result permits to estimate the existence of a point where the rating is changed largely among static friction coefficients ranging from "0.057" to "0.065". This value of the static friction coefficient is expected to be larger than 0.060 at least from the trend in the above each example and comparative example. Therefore, if "the static friction coefficient with common paper at 100° C. is 0.060 or less", the object of the present invention can be attained.

It is also understood that the rating is greatly dropped if the surface gloss is deviated from any of the upper limit and lower limit of the aforementioned defined range reading as follows "15 or more and 60 or less as the value measured by a 75° micro-gloss meter (BYK Gardner)". Because it is difficult to obtain examples in which only the surface gloss is changed, there is no data showing the very upper and lower limits of gloss. However, the lower limit "15" indicates a transition point that is inferred from the correlation between the desirable gloss of an image and the surface gloss of the surface layer and the upper limit "60" indicates a transition point that is inferred from the correlation between the surface gloss of the surface layer and the generation of paper wrinkles. The results of evaluation shows that the above examples and comparative examples are typical examples supporting these inferences.

When comparing the measured value of the filtered center waviness with the image transmission unevenness in OHP printing in each example and comparative example, it has been confirmed that no transmission unevenness is caused if the waviness is 0.7 μm or less, there is no practical problem though transmission unevenness is partially observed if the waviness exceeds 0.7 μm and practically unfavorable transmission unevenness is caused if the waviness exceeds 0.9 μm. As a consequence, the foregoing definition of a preferable range which reads as follows "0.9 μm or less in the condition of a cutoff of 0.25 mm" and the foregoing definition of a more preferable range which reads as follows "0.7 μm or less in the condition of a cutoff of 0.25 mm" are both appropriate.

It has been also confirmed from the results of evaluation of each of the sixth and seventh examples that good results of evaluation are obtained to the very upper limit of the foregoing defined range reading as follows "the content of the PFA powder is 5 mass parts or more and 70 mass parts or less based on 100 mass parts of the PFA fine particle" in relation to the ratio of the PFA powder to PFA fine particle to be compounded.

Comparison between the results of evaluation of the seventh example with the results of evaluation of the third comparative example shows that the upper limit of the foregoing definition "3 μm or less as Ra" as to the surface roughness of the surface layer is reasonable.

Also, comparison between the results of evaluation of each of the first to fifth examples and the results of evaluation of each of the sixth and seventh examples shows that the deviation from all of the aforementioned more preferable range reading as follows "3 μm or more and 15 μm or less) as to the average particle diameter of the PFA powder, the aforementioned more preferable range reading as follows "the melt viscosity at 380° C. is $1.5\times10^4$ Pa·s or less" as to the melt viscosity of the PFA fine particle, the aforementioned more preferable range reading as follows "the content of the PFA powder is 5 mass parts or more and 30 mass parts or less based on 100 mass parts of the PFA fine particle" as to the ratio of the PFA fine particle to the PFA powder and the aforementioned more preferable range reading as follows "the content of particles having a particle diameter of 15 μm or more is 5 mass % or less" as to the filler particle, causes transmission unevenness of an OHP image and voids of both-surface image though each example is on a practically no-problem level. Accordingly, it is predicted that products having a surface layer satisfying the requirement as to one or more of these more preferable ranges will stand comparison with the first to fifth examples.

It is understood that the provision of a surface layer having surface characteristics fulfilling the requirement as to the aforementioned ranges makes it possible to obtain a highly reliable circulating body.

What is claimed is:

1. A circulating body driven with its surface being circulated along a fixed route, the circulating body comprising:

a base material having a tubular outside peripheral surface; and a surface layer covering the outside peripheral surface of the base material and having a surface static friction coefficient of 0.06 or less with common paper at 100° C.

2. A circulating body according to claim 1, wherein the surface layer comprising a fluororesin containing an inorganic fine particle.

3. A circulating body according to claim 2, wherein the surface layer containing the inorganic fine particle in an amount of 1 mass % or more and 30 mass % or less based on 100 mass parts of the fluororesin.

4. A circulating body according to claim 2, wherein the surface layer contains, as the inorganic fine particle, at least one fine particle selected from the group consisting of a metal oxide fine particle, a mineral silicate fine particle and a metal nitride fine particle.

5. A circulating body according to claim 2, wherein the surface layer contains, as the inorganic fine particle, at least one fine particle selected from the group consisting of a $BaSO_4$ fine particle, a tin oxide fine particle, a zeolite fine particle, a mica fine particle and a boron nitride fine particle.

6. A circulating body according to claim 2, wherein the surface layer containing an inorganic fine particle having an average particle diameter of 0.1 μm or more and 15 μm or less.

7. A circulating body according to claim 2, wherein the surface layer containing an inorganic fine particle which has an average particle diameter of 0.1 μm or more and 15 μm or less and contains a particle having a particle diameter of 15 μm or more in an amount of 25 mass % or less.

8. A circulating body according to claim 2, wherein the surface layer containing a conductive fine particle in an amount of 1 mass part or more and 10 mass parts or less based on 100 mass parts of the fluororesin.

9. A circulating body according to claim 2, wherein the surface layer containing a copolymer of tetrafluoroethylene and perfluoroalkyl vinyl ether as the fluororesin.

10. A circulating body according to claim 9, wherein the surface layer containing, as the fluororesin, a composition of plural type of particles differing in the particle diameter of the copolymers wherein a second particle having an average particle diameter of 3 μm or more and 30 μm or less is compounded in an amount of 5 mass parts or more and 70 mass parts or less based on 100 mass parts of a first particle having an average particle diameter of 1 μm or less.

11. A circulating body according to claim 10, wherein the surface layer uses, as the first particle, a particle having a melt viscosity of $3.5\times10^4$ Pa·s or less at 380° C. and as the second particle, a particle having a melt viscosity of $1.5\times10^4$ Pa·s or less at 380° C.

12. A circulating body according to claim 10, wherein the surface layer uses, as both the first particle and the second particle, a particle having a melt viscosity of $1.5\times10^4$ Pa·s or less at 380° C.

13. A circulating body according to claim 1, wherein the surface layer has a surface roughness Ra of 3 μm or less.

14. A circulating body according to claim 1, wherein the surface layer has a surface gross of 15 or more and 60 or less as the value measured by a 75° micro-gloss meter (BYK Gardner).

15. A circulating body according to claim 1, wherein the surface layer has a filtered wave center line waviness of 0.9 μm or less in the condition of 0.25 mm cutoff.

16. A circulating body according to claim 1, wherein the base material has a roll-like shape, or a seamlessly belt-like shape.

17. A fixing device comprising:

a rotating roll-like fixing member;

a fixing tubular body rotating along with the rotation of the fixing member in contact with the fixing member;

a press member that is disposed inside of the fixing tubular body and presses this fixing tubular body against the fixing member to form a nip zone between the fixing tubular body and the fixing member; and a heating source that heats the nip zone; to fix an unfixed toner image to a recording medium by holding the recording medium carrying the unfixed toner image in the nip zone, wherein the fixing tubular body is provided with a seamlessly belt-like base material and a surface layer covering the outside peripheral surface of the base material and having a surface static friction coefficient of 0.06 or less with common paper at 100° C.

18. A fixing device according to claim 17, wherein the time required for a point on the recording medium to pass through the nip zone is 0.020 seconds or more.

* * * * *